US008243007B2

(12) United States Patent
Zhang et al.

(10) Patent No.: US 8,243,007 B2
(45) Date of Patent: Aug. 14, 2012

(54) IMAGE DISPLAY DEVICE AND METHOD

(75) Inventors: Wei Zhang, Tai Po Tsai Village (HK); Huajun Peng, Tai Po (HK); Chen-Jung Tsai, Shatin (HK); Chun-Kit Hung, San Po Kong (HK)

(73) Assignee: Hong Kong Applied Science and Technology Research Institute Co., Ltd., Shatin, New Territories (HK)

( * ) Notice: Subject to any disclaimer, the term of this patent is extended or adjusted under 35 U.S.C. 154(b) by 973 days.

(21) Appl. No.: 12/125,360

(22) Filed: May 22, 2008

(65) Prior Publication Data

US 2008/0291153 A1 Nov. 27, 2008

(30) Foreign Application Priority Data

May 22, 2007 (CN) ..... 2007 1 0103749

(51) Int. Cl.
*G09G 3/36* (2006.01)

(52) U.S. Cl. ..... 345/102; 345/87; 345/204

(58) Field of Classification Search ..... 345/240, 345/87, 102, 204
See application file for complete search history.

(56) References Cited

U.S. PATENT DOCUMENTS

2006/0007112 A1* 1/2006 Park ..... 345/102
2006/0267923 A1* 11/2006 Kerofsky ..... 345/102

FOREIGN PATENT DOCUMENTS

WO WO 2005/010939 A2 2/2005

OTHER PUBLICATIONS

Chinese Office Action for corresponding Chinese Patent Application No. 200710103749.9 mailed Sep. 18, 2009.

* cited by examiner

*Primary Examiner* — Alexander S Beck
*Assistant Examiner* — Jeffrey Steinberg
(74) *Attorney, Agent, or Firm* — Merchant & Gould P.C.

(57) ABSTRACT

An image display device is presented to solve problems of high power consumption, insufficient contrast, image flicker, and distortion of image display devices. The image display device includes an image display management module which includes a backlight control unit. The backlight control unit includes an image brightness analyzer, generating a brightness value according to an input image data; a weight generator, generating a weight according to the brightness value; an image variation analyzer, analyzing the input image data to generate an image variance; and a backlight factor generator, coupled to the weight generator and the image variation analyzer to generate a backlight adjusting signal according to the weight and the image variance. By the backlight adjusting signal, the image display device achieves the power-saving and contrast enhancement effects.

21 Claims, 6 Drawing Sheets

IMAGE DISPLAY DEVICE AND METHOD

BACKGROUND OF THE INVENTION

1. Field of the Invention

The present invention relates to an image display device and method, and more particularly, to a liquid crystal display device and method.

2. Description of the Prior Art

Liquid crystal displays (LCDs) are widely implemented in various electronic products such as computers, portable computers, and televisions. Conventional LCDs have two significant defects, namely, the high power consumption and the insufficient contrast. In electronic product, the power consumed by the LCD amounts to 30% to 70% of the total power consumption, and a backlight device therein is the most power-consuming. Therefore, a power-saving backlight device is needed to provide an LCD of lower power consumption. The problem of insufficient contrast is particularly obvious when the LCD displays a dark image. The image is too dark to form a contrast with the backlight. Therefore, an LCD capable of maintaining the contrast when the image is dark is needed.

In order to solve the above problems, in a prior art, an image display having a backlight control is provided, which achieves the control of the backlight according to an average brightness value and a maximum brightness value of the input image information. However, the image displayed by the front panel is not adjusted in the prior art, so the contrast extent is still insufficient. Moreover, the image analysis in the backlight control device is too simple so that the analyzed information cannot represent features of the input image information. In another prior art, a brightness histogram of an input image is generated according to the input image information and is then used to adjust the backlight, for solving the defects in analysis of the above prior art. Although this analysis may over the defects of the above art, it is still unable to actually show features of the input image. Moreover, the way of merely using the histogram in the analysis readily causes flicker of the adjusted image or distorts the image.

Therefore, an image display device is needed to solve the above problems of high power consumption, insufficient contrast, image flicker, and distortion.

SUMMARY OF THE INVENTION

In order to solve the above problems, the present invention provides an image display management module, which includes a backlight control unit. The backlight control unit includes an image brightness analyzer, generating a brightness value according to an input image data; a weight generator, generating a weight according to the brightness value; an image variation analyzer, analyzing the input image data to generate an image variance; and a backlight factor generator, coupled to the weight generator and the image variation analyzer to generate a backlight adjusting signal according to the weight and the image variance.

The present invention provides a method for compensating an input image data. The method includes the following steps. An image brightness analyzer determines a brightness value of the input image data. A weight generator generates a weight for the brightness value. An image variation analyzer analyzes the input image data to generate an image variance. A backlight factor generator generates a backlight adjusting signal according to the histogram weight and the image variance. A compensated image output is generated according to the backlight adjusting signal and an image data from an image control unit.

The present invention provides an image display management module, which includes an image control unit. The image control unit includes a low-pass filter, for blurring an input image data; a gain factor selector, coupled to the low-pass filter to determine a gain factor; and an output data generator, coupled to the gain factor selector to generate an output image data.

The present invention provides a method for compensating an input image data. The method includes the following steps. A low-pass filter blurs an input image data. A gain factor selector determines a gain factor according to the blurred input image data. An output data generator generates an output image data according to the gain factor and the input image data. A compensated image output is generated according to the output image data and a backlight adjusting signal from a backlight control unit.

DETAILED DESCRIPTION

Figure 1:
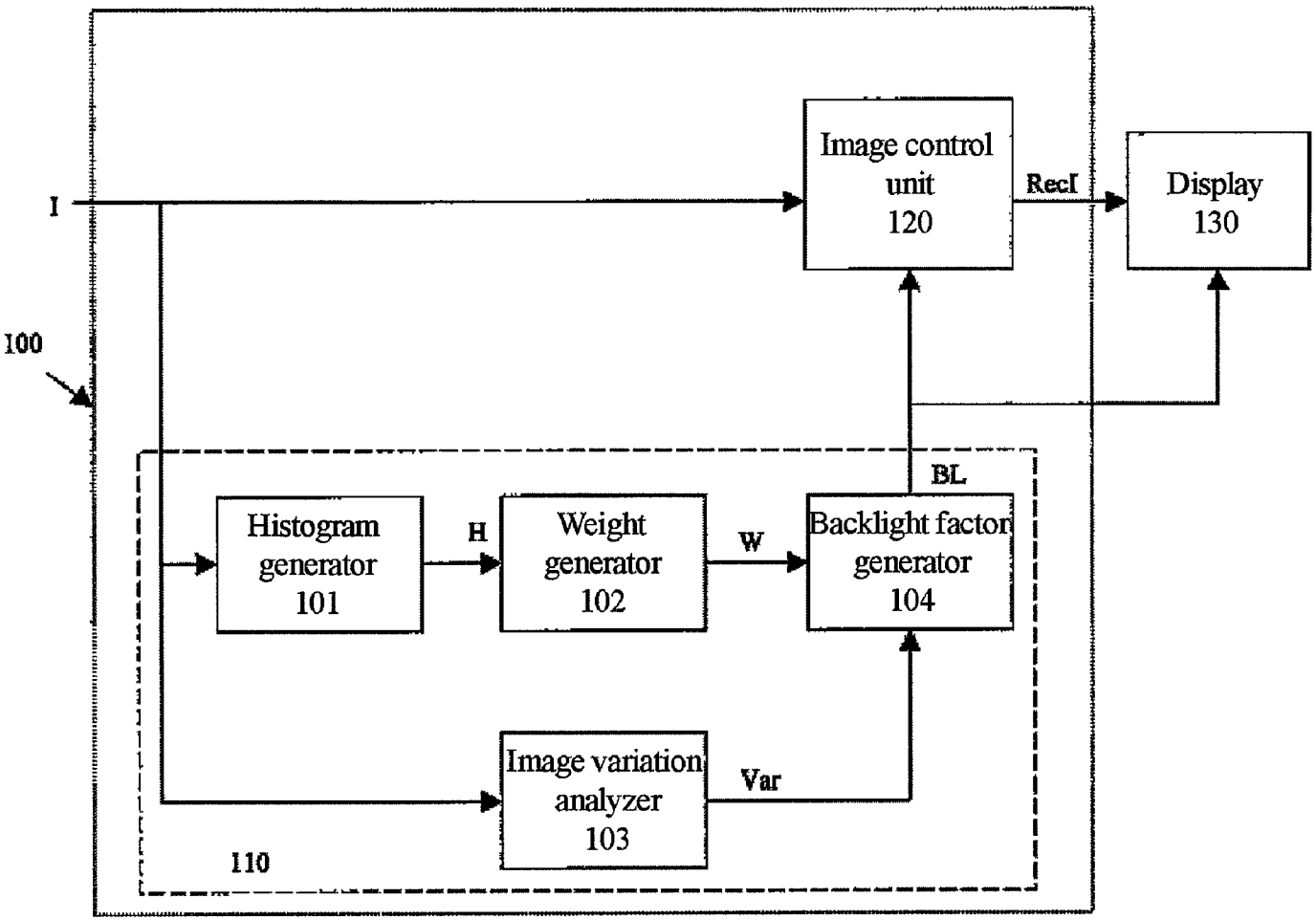
FIG. 1 is a schematic view of an image display management module according to the present invention.

The present invention will be described comprehensively hereinafter with reference to the accompanying drawings illustrating the specific embodiments of the present invention. However, the present invention should not be considered as limited to the specific embodiments. More correctly, the specific embodiments are provided to thoroughly and completely disclose the content of the present invention, and fully convey the scope of the present invention to those skilled in the art. In the drawings, the thicknesses of layers and regions are enlarged for clarity. Like numbers refer to like elements appearing in all the drawings. The term "and/or" in the present invention includes any and all combinations of one or more of the associated items.

The terminology used herein is used for describing particular specific embodiments only and is not intended to limit the scope of the present invention. The singular forms "a," "an" and "the" in the present invention include the plural forms as well, unless other circumstances are clearly indicated. It should be further understood that the terms "comprise" and/or "include" when used in this specification, specify the presence of the features, integers, steps, operations, elements, and/or components, but do not preclude the presence or addition of one or more other features, integers, steps, operations, elements, components, and/or groups thereof.

It will be understood that when an element of a layer or region is referred to as being "on" or "extending onto" another element, it may be directly on or directly extending onto the other element or intervening elements may also be present. In contrast, when an element is referred to as being "directly on" or "directly extending onto" another element, no intervening element exists. It will also be understood that when an element is referred to as being "connected to" or "coupled to" another element, it may be directly connected or coupled to another element or intervening elements may be present. In contrast, when an element is referred to as being "directly connected to" or "directly coupled to" another element, no intervening element exists.

It will be understood that, although the terms first, second, etc. may be used herein to describe various elements, components, regions, layers, and/or sections, these elements, components, regions, layers and/or sections should not be limited by these terms. These terms are only used to distinguish one element, component, region, layer, or section from another element, component, region, layer, or section. Thus, a first element, component, region, layer, or section discussed below may be referred to as a second element, component, region, layer, or section without departing from the principles of the present invention.

In addition, relative terms, for example, "lower", "bottom", or "horizontal" and "upper", "top", or "vertical" may be used herein to describe one element's relationship to another element as illustrated in the drawings. It will be understood that the relative terms are intended to encompass different orientations of the device in addition to the orientation depicted in the drawings. For example, if the device in the drawings is turned over, elements described as at a "lower" side of other elements would then be oriented at an "upper" side of the other elements. Thus, the exemplary term "lower" may encompass both "lower" and "upper" orientations depending on the particular orientation of the drawings. Similarly, if the device in one of the drawings is turned over, elements described as "below" or "beneath" other elements would then be oriented "above" the other elements. Thus, the exemplary term "below" or "beneath" may encompass both orientations of above and below.

Specific embodiments of the present invention are described herein with reference to sectional view of ideal specific embodiments of the present invention. As such, it may be expected that the shapes may vary according to manufacturing techniques and/or tolerances. Therefore, specific embodiments of the present invention should not be construed as limitations to the particular shapes of regions illustrated in the present invention, but should be construed to include deviations in shapes that result, for example, from manufacturing. For example, a region illustrated or described as a cone-shaped region usually has a circular vertex and rough and/or nonlinear features. Thus, the regions in the figures are illustrated for exemplifying instead of being interpreted as an accurate shape to limit the scope of the present invention. In addition, terms such as "horizontal" and "vertical" refer to general directions or relationships besides the exact orientations of 0 degree or 90 degrees.

Unless additionally defined, all terms (including technical and scientific terms) used herein have the same meaning as commonly understood by those skilled in the art to which the present invention belongs. It will be further understood that terms, such as those defined in commonly used dictionaries, should be interpreted as having a meaning that is consistent with their meaning in the context of the relevant art, and will not be interpreted in an ideal or overly formal sense unless clearly defined herein.

FIG. 1 is a schematic view of an image display management module 100 according to the present invention. The image display management module 100 includes a backlight control unit 110. The backlight control unit 110 includes an image brightness analyzer which is implemented by a histogram generator 101 in this embodiment, a weight generator 102, an image variation analyzer 103, and a backlight factor generator 104. The histogram generator 101 is connected to the weight generator 102, and the weight generator 102 is connected to the backlight factor generator 104, while the image variation analyzer 103 is similarly connected to the backlight factor generator 104.

The histogram generator 101 in the backlight control unit 110 generates a histogram value H according to an input image data I and transfers the histogram value H to the weight generator 102. The weight generator 102 calculates a weight W according to the histogram value and transfers the weight W to the backlight factor generator 104. The image variation analyzer 103 generates an image variance Var according to the input image data I and similarly transfers the image variance Var to the backlight factor generator 104. The backlight factor generator 104 then generates a backlight adjusting signal BL according to the received weight W and image variance Var. The image display management module 100 may directly display the backlight according to the backlight adjusting signal BL transferred to a display 130, thereby managing the image display through the backlight adjustment, or transfer the backlight adjusting signal BL after being processed by an image control unit 120 to the display 130.

Figure 2A:
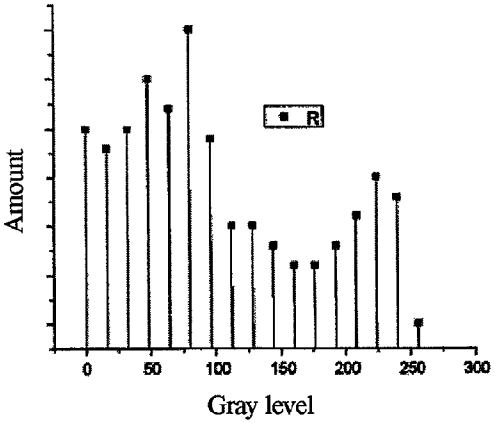
FIGS. 2*a* to 2*d* are histograms of a brightness signal according to the present invention.
Figure 2B:
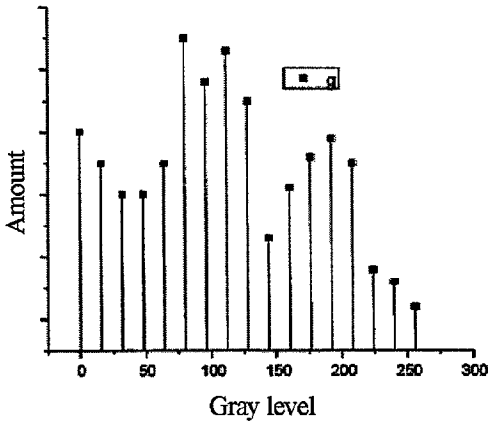
Figure 2C:
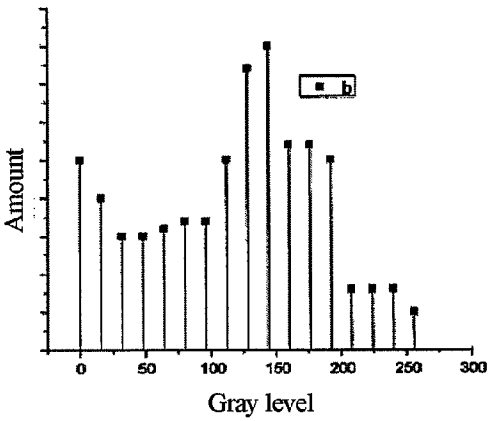
Figure 2D:
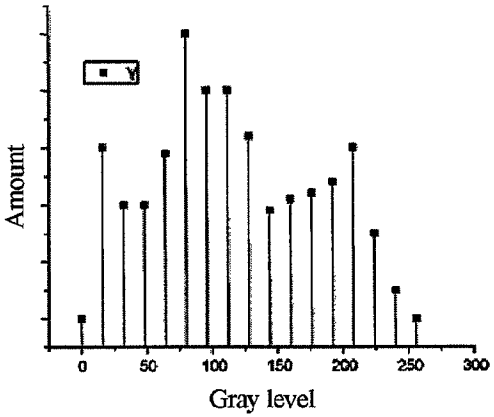

The input image data is usually composed of signals of red, green, and blue colors. The intensity of signals of each color is divided into 256 gray levels. For any input frame, histograms may be generated for signals of three colors respectively. FIGS. 2*a*, 2*b*, and 2*c* are respectively histograms of three colors. A brightness signal Y and chromaticity signal U and V of the frame may be obtained by signals of three colors. The brightness signal Y and chromaticity signal U and V may be calculated based on the following equations:

$$Y=0.229*R+0.587*G+0.114*B$$

$$U=-0.147*R-0.289*G+0.437*B$$

$$V=0.615*R-0.515*G-0.1*B$$

The brightness signal Y may also be divided into 256 gray levels. As such, a histogram 2*d* of the brightness signal may be obtained. The weight generator 102 may calculate the weight W according to the histogram of the brightness signal.

Figure 3:
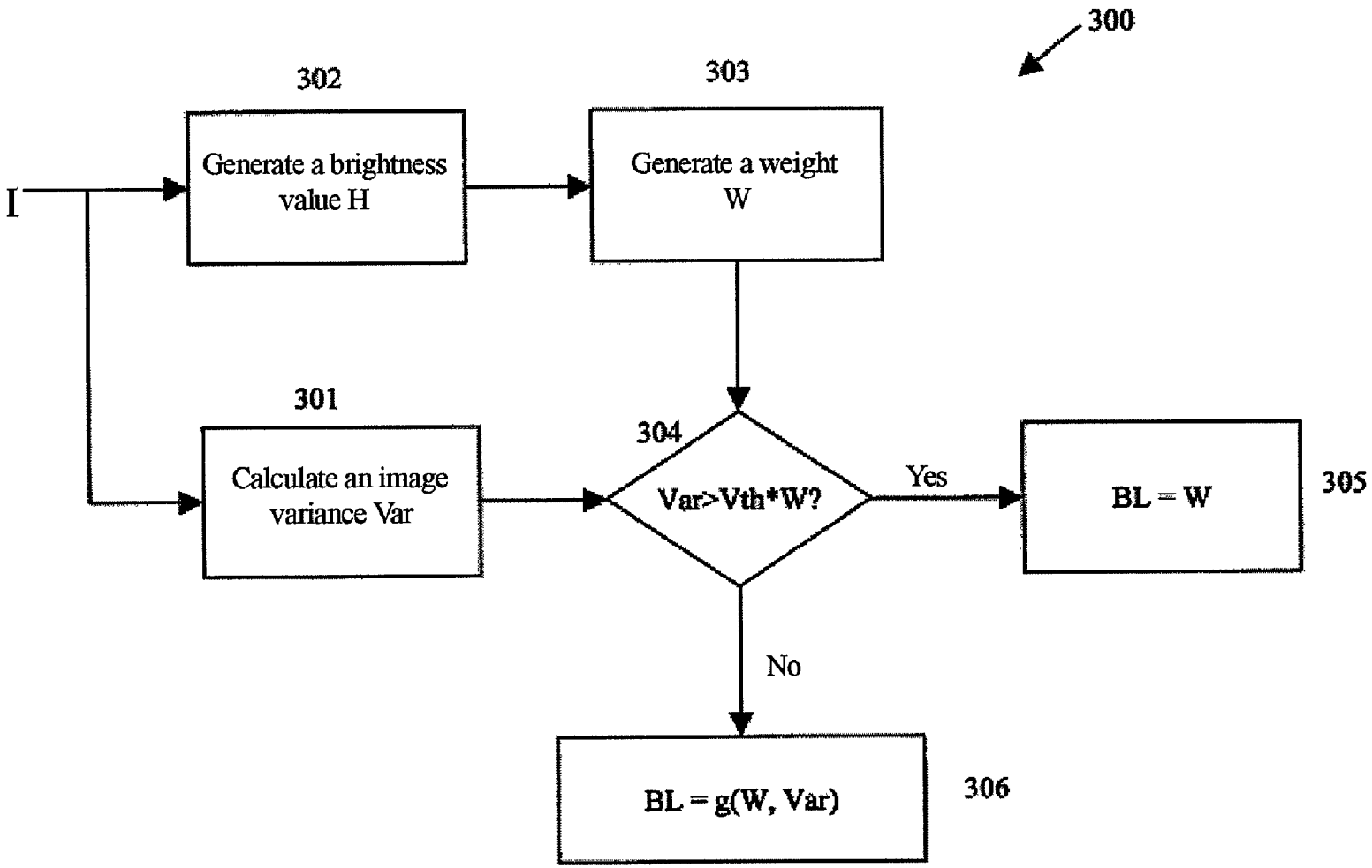
FIG. 3 is a flow chart of a method for calculating a backlight adjusting signal according to the present invention.

The backlight adjusting signal BL is adjusted based on the following principle. When the image is dark or the gray level distribution is narrow, the brightness of the backlight is adjusted lower. When the image is bright or the image contains bright and dark portions or has a uniform gray level distribution, the brightness of the backlight is adjusted higher. Since the histograms of the image only roughly show the brightness distribution of the image, the variation of the brightness distribution of the image needs to be further calculated. FIG. 3 is a flow chart 300 of a method for calculating a backlight adjusting signal BL according to the present invention. First, in Step 301, an image variance Var of an input image data I is calculated based on Equation 1.

$$\mathrm{Var} = \frac{1}{M \times N} \sum_{i=1}^{M} \sum_{j=1}^{N} [I(i, j) - \bar{I}]^2 \qquad \text{Equation 1}$$

where $$\bar{I} = \frac{1}{M \times N} \sum_{i=1}^{M} \sum_{j=1}^{N} I(i, j) \qquad \text{Equation 2}$$

where M×N represents a size of the image, and I(i, j) represents a position of every pixel in the image. In Step 302, a brightness value H of the input image data I is calculated. Then, in Step 303, a weight W of the brightness value H is generated based on Equation 3, in which the image backlight minimum $W_{min}$ is a predetermined value.

$$W = \frac{(1 - W_{min}) \times \bar{I}}{255} + W_{min} \quad \text{Equation 3}$$

and $$W \in [0.7,1]$$

In Step 304, the image variance Var is compared with a product of an image variation threshold $V_{th}$ and the weight W to see if the image variance Var is larger than the product, and if so, Step 305 is performed to confirm that the backlight adjusting signal BL is the weight W. Otherwise, Step 306 is performed to confirm that the backlight adjusting signal BL is a function of the weight W and the image variance Var. The function may be expressed by Equation 4, where the image variation threshold $V_{th}$ is a predetermined value.

$$g(W, \mathrm{Var}) = W - \frac{(V_{th} \times W - \mathrm{Var})}{3 \times V_{th} \times W} \quad \text{Equation 4}$$

It can be seen from the result of the process 300 that when the variation of the input image data I is small, the backlight adjusting signal BL is smaller than the weight W. When the variation of the input image data I is large, the backlight adjusting signal BL is approximately equal to the weight W. Therefore, the image display management module 100 adjusts the brightness of the backlight lower to reduce the power consumption when the brightness distribution of the input image is uniform, and adjusts the brightness of the backlight higher to enhance the contrast when the variation of the brightness distribution of the image is large, so as to avoid the flicker effect.

Figure 4:
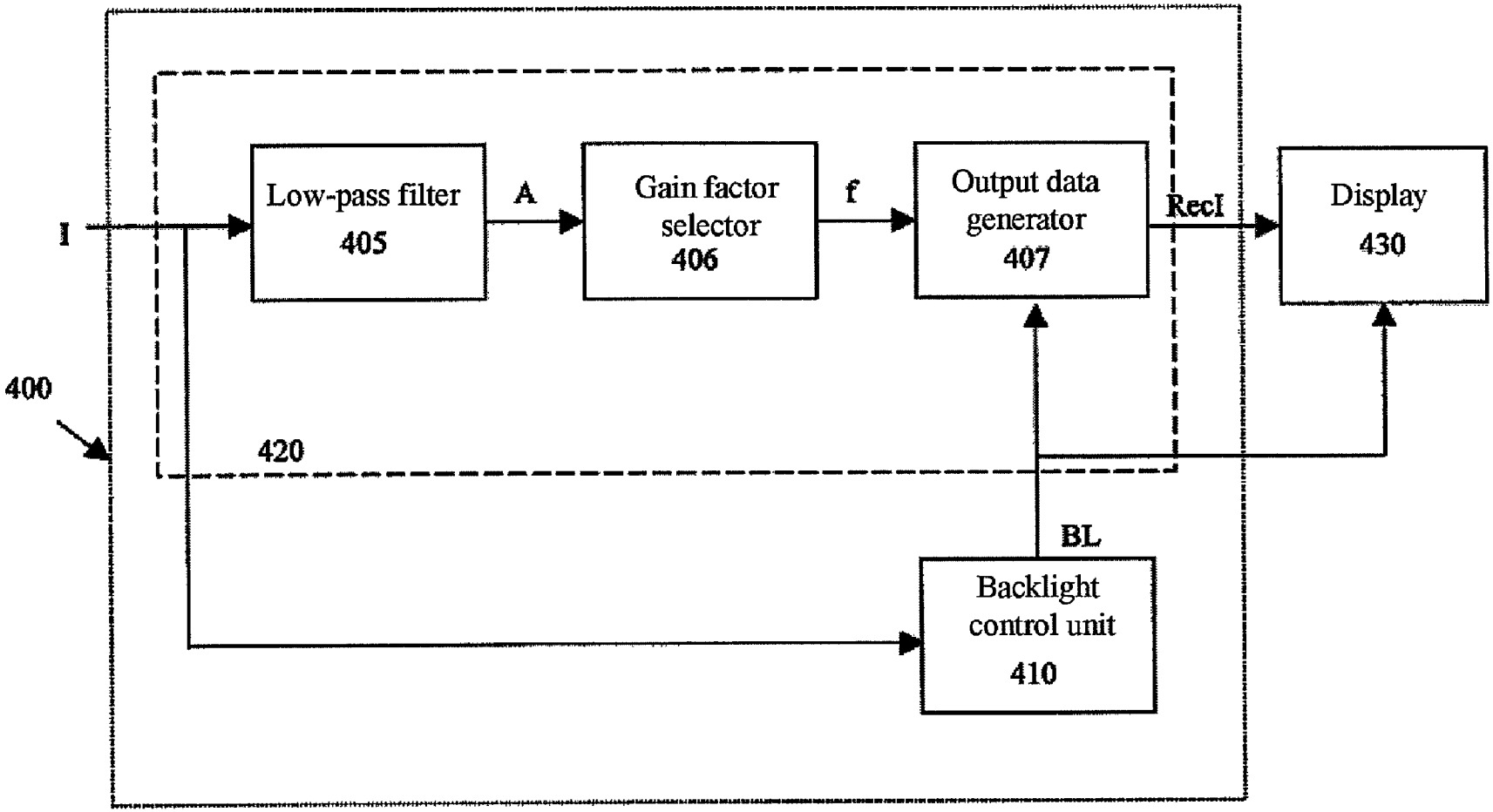
FIG. 4 is a schematic view of another image display management module according to the present invention.

FIG. 4 is a schematic view of an image display management module 400 according to the present invention. The image display management module 400 includes an image control unit 420. The image control unit 420 includes a low-pass filter 405, a gain factor selector 406, and an output data generator 407. The low-pass filter 405 is connected to the gain factor selector 406 which is connected to the output data generator 407.

The low-pass filter 405 in the image control unit 420 filters high frequencies in an input image data I. In other words, the filtered image data of the input image data I is blurred and formed an ambient image data A. This may reduce the amount of the data to be processed and may process the image data sensitive to the backlight. After the ambient image data A is transferred from the low-pass filter 405 to the gain factor selector 406, the gain factor selector 406 may determine a gain factor f according to the ambient image data A by the logic of the method illustrated in FIG. 4. The gain factor f is transferred from the gain factor selector 406 to the output data generator 407. The output data generator 407 then generates an output image data RecI according to the gain factor f. The image display management module 400 transfers the output image data RecI to a display, such that the display may display the image according to the output image data RecI.

Figure 5:
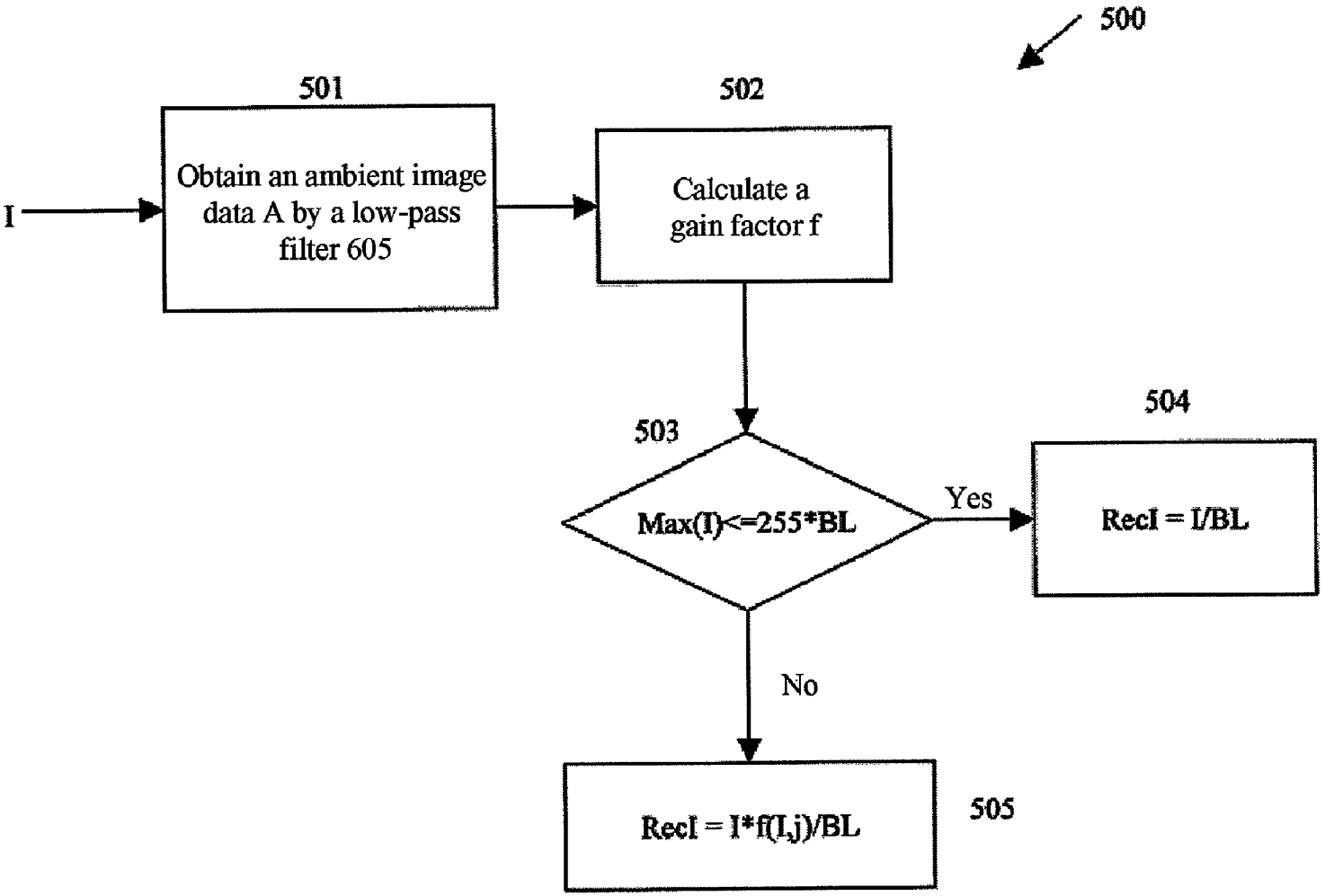
FIG. 5 is a flow chart of a method for calculating an output image data according to the present invention.

FIG. 5 is a flow chart 500 of a method for calculating an output image data RecI according to the present invention. In Step 501, an input image data I obtains an ambient image data A by a low-pass filter 405. In Step 502, a gain factor selector 406 calculates a gain factor f according to ambient image data A based on Equation 5, in which an image variation threshold $A_0$ is a predetermined value.

$$f = \frac{F_{max} - F_{min}}{A_{min} - A_0} \times A(i, j) + \frac{F_{min} \times A_{min} - F_{max} \times A_0}{A_{min} - A_0} \quad \text{if } A(i, j) < A_0$$
$$= F_{min} \quad \text{if } A(i, j) \geq A_0 \quad \text{Equation 5}$$

where $F_{min}$ and $F_{max}$ are defined as:

$$F_{min} = \frac{255 \times BL}{I_{max}} < 1$$
$$F_{max} = 2 - F_{min}^{1/4} > 1$$

In Step 503, a maximum of the input image data I is compared with a product of 255 and the backlight adjusting signal BL to see if the maximum is less than or equal to the product, and if so, Step 504 is performed to confirm that the output image data RecI is the input image data I divided by the backlight adjusting signal BL. Otherwise, the Step 505 is performed to confirm that the output image data RecI is a product of the input image data I and the gain factor f divided by the backlight adjusting signal BL. Based on the calculation of the process 500, the output image data RecI may be adjusted according to the intensity of the backlight adjusting signal BL, thereby avoiding the saturation of extremely dark and bright places in the image to distort the image.

Figure 6:
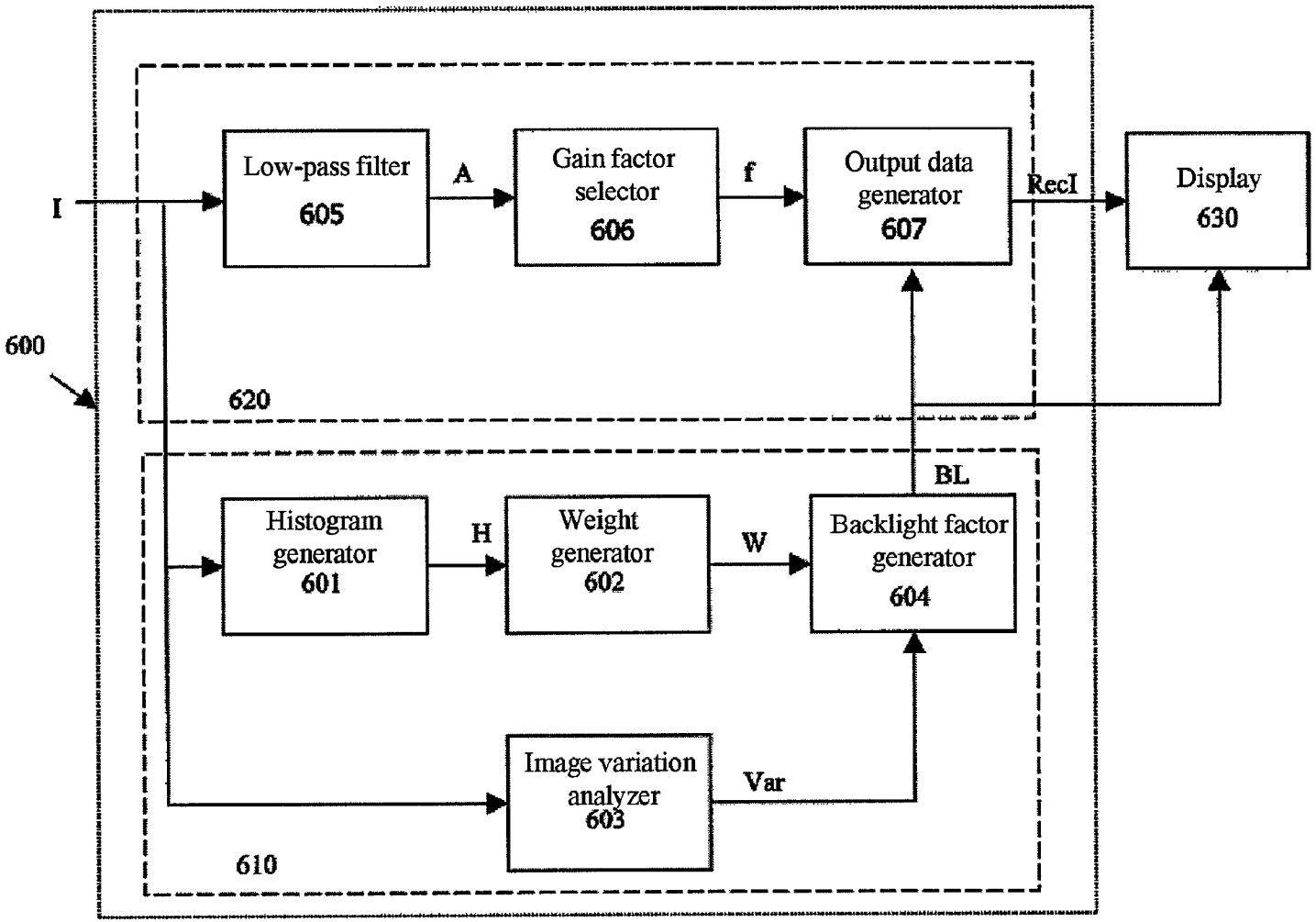
FIG. 6 is a schematic view of another image display management module according to the present invention.

FIG. 6 is a schematic view of an image display management module 600 according to the present invention. The image display management module 600 includes a backlight control unit 610 and an image control unit 620 as described above. The backlight control unit 610 is connected to an output data generator 607 of the image control unit 620 via a backlight factor generator 604. Thus, the output data generator 607 calculated an output image data RecI according to a gain factor f and a backlight adjusting signal BL. The image display management module 600 transfers the output image data RecI and the backlight adjusting signal BL to a display, such that the backlight of the display is displayed according to the backlight adjusting signal BL and the image displayed by a front panel is the output image data RecI.

LIST OF REFERENCE NUMERALS

100 image display management module
101 histogram generator
102 weight generator
103 image variation analyzer
104 backlight factor generator
110 backlight control unit
120 image control unit
130 display
400 image display management module
405 low-pass filter
406 gain factor selector
407 output data generator
420 image control unit
430 display
600 image display management module
604 backlight factor generator

607 output data generator
610 backlight control unit
620 image control unit
A ambient image data
BL backlight adjusting signal
f gain factor
H histogram value
I input image data
RecI output image data
Var image variance
W weight

We claim:

1. An image display management module, comprising a backlight control unit which comprises:

a histogram generator generating a brightness histogram according to an image data of an input frame;

a weight generator presetting corresponding weights according to a plurality of image brightness values and coupled to the histogram generator generating a weight corresponding to the histogram;

an image variation analyzer analyzing the image data of the input frame to generate an image variance; and a backlight factor generator coupled to the weight generator and the image variation analyzer to generate a backlight adjusting signal according to the weight and the image variance of the input frame.

2. The image display management module according to claim 1, further comprising an image control unit comprising:

a low-pass filter for blurring the input image data;

a gain factor selector coupled to the low-pass filter to generate more than one gain factor according to the blurred image data and the backlight adjusting signal; and an output data generator coupled to the gain factor selector and the backlight factor generator to generate an output image data.

3. The image display management module according to claim 2, wherein the output image data is generated by the output data generator according to the input image data, the gain factors, and the backlight adjusting signal.

4. The image display management module according to claim 1, wherein the weight generator coupled to the histogram generator comprises:

generating an average brightness of the input frame according to the histogram; and generating, by the weight generator, a weight corresponding to the frame according to the average brightness value.

5. The image display management module according to claim 1, wherein the weight generator coupled to the histogram generator comprises:

generating a weighted average brightness of the input frame according to the preset weights and the histogram; and generating, by the weight generator, a weight corresponding to the frame according to the weighted average brightness value.

6. The image display management module according to claim 1, wherein the preset weights in the weight generator increase with an increase of the brightness values or remain unchanged.

7. The image display management module according to claim 4, wherein the image variation analyzer calculates according to the average brightness value of the image or the weighted average brightness of the image.

8. An image display comprising the image display management module according to claim 1 or 2, generating a compensated image output according to the image data and the backlight adjusting signal.

9. A method for compensating an input image data, comprising:

determining, by a histogram generator, a brightness histogram of the input image data;

generating, by a weight generator, a weight according to the brightness histogram;

analyzing, by an image variation analyzer, the input image data to generate an image variance;

generating, by a backlight factor generator, a backlight adjusting signal according to the histogram weight and the image variance; and generating a compensated image output according to the backlight adjusting signal and image data from an image control unit.

10. The method according to claim 9, wherein the output image data is generated by an output data generator according to multiple gain factors, the input image data, and the backlight adjusting signal.

11. The method according to claim 9, wherein the output image data is generated by an output data generator according to multiple gain factors and the input image data.

12. The method according to claim 9 or 10, wherein the gain factors are generated through processing the input image data blurred by a low-pass filter by a gain factor selector.

13. An image display management module, comprising an image control unit which comprises:

a low-pass filter for blurring an input image data;

a gain factor selector coupled to the low-pass filter to determine multiple gain factors from the low-pass filtered image data; and an output data generator coupled to the gain factor selector to apply the gain factor to the input image data to generate an output image data.

14. The image display management module according to claim 13, further comprising a backlight control unit which comprises:

a histogram generator, generating a histogram value according to the input image data;

a weight generator coupled to the histogram generator to generate a weight of the histogram value;

an image variation analyzer analyzing the input image data to generate an image variance; and a backlight factor generator coupled to the weight generator and the image variation analyzer to generate a backlight adjusting signal according to the weight and the image variance;

wherein the backlight control unit is coupled to the output data generator to provide the backlight adjusting signal to the output data generator.

15. The image display management module according to claim 13, wherein the backlight factor generator is coupled to an image display to provide the backlight adjusting signal to the image display.

16. The image display management module according to claim 13, wherein the output image data is generated by the output data generator according to the input image data, the gain factors, and the backlight adjusting signal.

17. An image display comprising the image display management module according to claim 13 or 14, generating a compensated image output according to the image data and the backlight adjusting signal.

18. A method for compensating an input image data, comprising:

blurring by a low-pass filter, an input image data;

determining, by a gain factor selector, multiple gain factors according to the blurred input image data;

generating, by an output data generator, an output image data according to the multiple gain factors and the input image data; and generating a compensated image output according to the output image data and a backlight adjusting signal from a backlight control unit.

19. The method according to claim 18, wherein the backlight adjusting signal is generated by a backlight factor generator according to a weight and an image variance.

20. The method according to claim 19, wherein the weight is generated by a weight generator according to a histogram of the input image data.

21. The method according to claim 19, wherein the image variance is generated through analyzing the input image data by an image variation analyzer.

* * * * *